US005904360A

United States Patent [19]

Oliemans et al.

[11] Patent Number: 5,904,360

[45] **Date of Patent: *May 18, 1999**

[54] FLEXIBLE SKATE FRAME

[75] Inventors: Eduard W. H. Oliemans, Aspen; Robert S. Stoughton, Carbondale, both of Colo.

[73] Assignee: 99 Innovations, Inc., Aspen, Colo.

[ * ] Notice: This patent is subject to a terminal disclaimer.

[21] Appl. No.: 08/758,190

[22] Filed: Nov. 25, 1996

Related U.S. Application Data

[63] Continuation-in-part of application No. 08/497,284, Jun. 30, 1995, Pat. No. 5,704,620.

[51] Int. Cl.[6] ..... A63C 1/24

[52] U.S. Cl. ..... 280/11.28; 280/11.22; 280/11.27

[58] Field of Search ..... 280/11.28, 11.27, 280/11.22, 11.23

[56] References Cited

U.S. PATENT DOCUMENTS

| | | | |
|---|---|---|---|
| 1,988,055 | 6/1935 | Stein . | |
| 2,689,743 | 9/1954 | Ware . | |
| 3,653,678 | 4/1972 | Collett . | |
| 3,774,924 | 11/1973 | Machatsch . | |
| 4,108,450 | 8/1978 | Cote . | |
| 4,272,090 | 6/1981 | Wheat . | |
| 4,272,091 | 6/1981 | Reid, Jr. | 280/11.28 |
| 4,398,735 | 8/1983 | Evans et al. | 280/11.28 |
| 4,402,521 | 9/1983 | Mongeon . | |
| 4,708,352 | 11/1987 | Vullierme | 280/11.26 |
| 5,092,614 | 3/1992 | Malewicz | 280/11.22 |
| 5,257,793 | 11/1993 | Fortin . | |
| 5,330,208 | 7/1994 | Charron et al. . | |
| 5,342,071 | 8/1994 | Soo . | |
| 5,405,156 | 4/1995 | Gonella . | |
| 5,503,413 | 4/1996 | Belogour | 280/11.22 |
| 5,531,462 | 7/1996 | Gu | 280/7.13 |
| 5,533,740 | 7/1996 | Lin | 280/11.22 |
| 5,549,310 | 8/1996 | Meibock et al. | 280/11.22 |
| 5,551,713 | 9/1996 | Alexander | 280/11.19 |
| 5,582,418 | 12/1996 | Closser | 280/11.22 |
| 5,586,777 | 12/1996 | Wolf | 280/11.22 |
| 5,738,360 | 4/1998 | Petell et al. | 280/11.22 |

FOREIGN PATENT DOCUMENTS

| | | |
|---|---|---|
| 493551 | 3/1930 | Germany . |

*Primary Examiner*—Christopher P. Ellis
*Attorney, Agent, or Firm*—Sheridan Ross P.C.

[57] ABSTRACT

Several embodiments of open and closed loop frames substantially elliptical in shape are disclosed for in-line skates. Some embodiments include independent suspension for each wheel. The frame is flexible to provide shock absorption and rebound. The frame stiffness increases with the applied load. The frame stiffness and flexibility may be adjustable. The rocker of the skate is made to vary with the applied load so that the skate has high maneuverability yet is very stable when gliding. The frame includes a boot mounting system which adds no stress concentrations, thus assuring even flex properties over the entire frame, and high durability. Overload protection is included to further enhance durability.

23 Claims, 20 Drawing Sheets

FLEXIBLE SKATE FRAME

RELATED APPLICATIONS

This application is a continuation-in-part of U.S. Pat. application Ser. No. 08/497,284, filed Jun. 30, 1995, U.S. Pat. No. 5,704,620, the entire disclosure of which is incorporated by reference herein.

FIELD OF INVENTION

The present invention relates to an in-line skate having a suspension system including an elliptical spring frame construction functioning to provide shock absorption, rebound and improved performance for the in-line skate.

BACKGROUND OF THE INVENTION

Although some in-line skating takes place on very smooth surfaces, most of the time skating takes place on boardwalks, bike paths, streets and city parks. Rough surfaces are the rule rather than exception for in-line skaters.

In-line skates are also used for stunts. It is not uncommon to see skaters jump off ramps or walls, descend with high speeds down stairs or glide down handrails. In many cases the landings can be rough.

Skates on the market today are essentially rigid, and thus fully transmit the shocks encountered at the wheels to the skater's body. This makes skating on less-than-ideal surfaces uncomfortable and fatiguing, and thus, less enjoyable and safe. Many skates have frames which are bolted or riveted to the boots. The associated holes add stress concentrations to the frame which weaken it. To compensate, the frames are made heavier and more rigid.

Several attempts have been made to reduce the vibrations caused by rough roads by adding springs to the design. This increases the number of parts and makes construction of the skate more difficult.

The present invention offers a suspension system with a truly simple and elegant elliptical frame design to the in-line skate industry that features the performance advantages of shock absorption, rebound and high maneuverability. In an alternative embodiment, the present invention further offers an adjustable suspension system to attain enhanced and variable performance characteristics. Both open loop and closed loop frame embodiments are disclosed. All the skate wheels are supported in a highly shock absorbent manner. Additionally, each in-line skate wheel can be independently suspended. Moreover, the suspension system may be adjusted to increase or decrease shock absorption, rebound and maneuverability, complementary to the skills of the individual user. The overall design is also light weight and can be produced in a cost efficient manner.

SUMMARY OF THE INVENTION

The main object of the present invention is to provide a shock absorbent elliptical frame for a more comfortable skating experience.

Another object of the present invention is to provide independent suspension for each in-line skate wheel.

Another object of the invention is to provide an adjustable suspension system for tuning performance characteristics of the skate as desired.

Another object of the present invention is to provide a low cost and light weight frame for an in-line skate.

Another object of the present invention is to provide a suspension system for use with an in-line skate to enhance rebound of stored energy and absorb vibrations and shock for a more efficient less fatiguing, and safer skating experience.

Another object of the present invention is to provide a highly maneuverable frame which increases the performance for street hockey, stunts and figure skating. High maneuverability also increases safety for experienced skaters as it becomes easier to avoid obstacles.

Another object of the present invention is to provide a flexing frame with overload protection for a highly durable construction.

Another object of the present invention is to provide a frame which is easy to constructs one piece bars that can be easily and economically produced by stamping or injection molding.

Another object of the present invention is to provide a one-piece frame.

Another object of the present invention is to provide a frame system that can interchange frames of different stiffnesses and rebound properties to accommodate skaters of different weights capabilities, and styles of skating such as racing or making ski-like turns.

Another object of the present invention is to provide an in-line skate system where frame and mounting blocks form an integrated system, and stress points are substantially reduced or eliminated.

Another object of the present invention is to provide a mounting system which does not add any stress concentrations (i.e., drilling, riveting, etc.) to the frame, so that the frame maintains its structural strength as well as flex properties over the entire length.

Another object of the present invention is to provide a system in which the flexibility/stiffness is adjustable.

Another object of the present invention is to provide a system in which all wheels maintain contact with the road surface while gliding, even on less than ideal surface resulting in more control.

Another object of the present invention is to provide mounting blocks which include 'sidewalls' which grip around the overload protection columns to allow vertical flexibility while maintaining high torsional and lateral stiffness.

Another object of the present invention is to provide a frame which functions as a cushion for landings and a springboard for jumps.

Another object of the present invention is to provide a frame for which the rocker is not a constant value but varies with the load, so that a short radius rocker is present in the unloaded skate, with the rocker flattening out with increasing load. This allows greater maneuverability without sacrificing stability. The frame can be designed so that the rocker becomes completely flat at the average push-off force of the skater. In this way, all the wheels of the skate actively participate in the push-off, yet the skate has a rocker while initiating a turn for good maneuverability.

Another object of the present invention is to provide a frame for which the rocker is continuously adjustable so that it can be precisely tuned.

Another object of the present invention is to provide a suspension system that allows the frame to be preloaded in a variable amount.

Another object of the present invention is to provide a mounting system which allows variable boot mount locations: from one single point at or near the center of the boot to multiple points distributed from front to back of the boot.

Another object of the present invention is to provide a boot mount system using one fixed mount (front or rear) and a second mount that is free to slide in the front to back direction. This changes the flex properties of the frame and allows the boot to remain relatively undeflected while the frame flexes.

Another object of the present invention is to provide a boot mount system using a fixed center mount with the front and back constrained laterally and torsionally, but free to slide in the front and back direction. This system can provide lateral and torsional support for the boot while allowing the maximum vertical flex of the frame.

Another object of the present invention is to provide a frame in which the cross-sectional shape of each bar varies along its length in such a way that the stress is evenly distributed along the length of the bar based on a given design load. This can maximize the amount of vertical flex achievable while keeping the maximum stress below a given level and maintaining or enhancing lateral and torsional stiffness of the frame. For a rectangular cross section bar, this includes varying the height and depth of the bar both independently and in concert. For a "C"-beam or "I"-beam cross-section, this includes maintaining a constant wall thickness.

Another object of the present invention is to provide frame stiffeners, attachable to two or more axles to stiffen and/or preload the frame to further vary performance characteristics.

Other objects of this invention will appear from the following description and appended claims, reference being made to the accompanying drawings forming a part of this specification wherein like reference characters designate corresponding parts in the several views.

Before explaining the disclosed embodiments of the present invention in detail, it is to be understood that the invention is not limited in its application to the details of the particular arrangement shown, since the invention is capable of other embodiments. Also, the terminology used herein is for the purpose of description and not of limitation.

DESCRIPTION OF THE PREFERRED EMBODIMENTS

Figure 1:
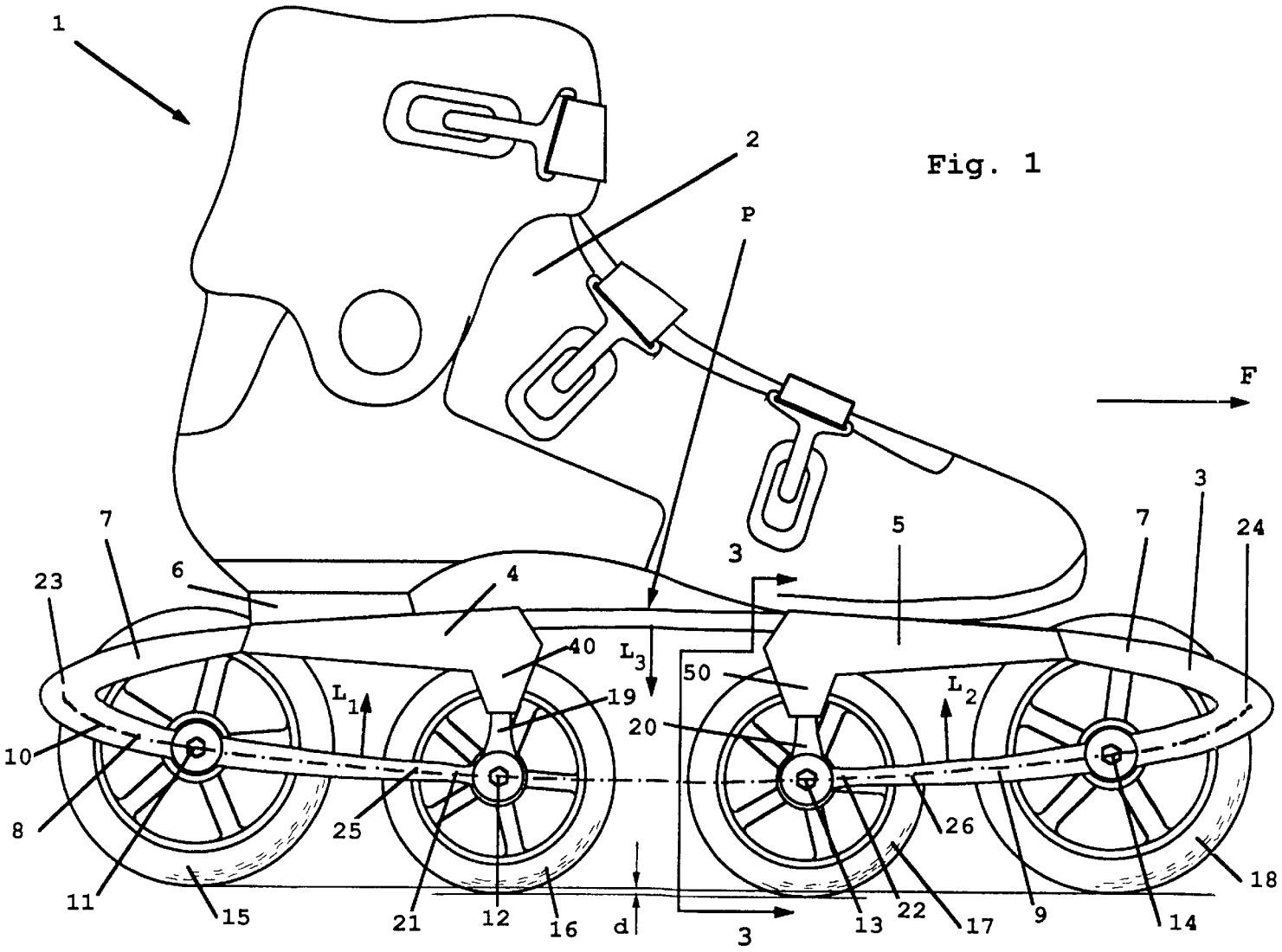
FIG. 1 is a right side plan view of the preferred embodiment.

Referring first to FIG. 1, an in-line skate 1 has a boot 2 having a bottom plane (not shown) coming out of the page at the bottom of the boot, an open elliptical frame 3, mounting blocks 4 and 5, and a heel elevator 6. The open elliptical frame 3 is symmetrical having a peak at P in the center of the ellipse and between the mounting blocks 4 and 5. The one piece elliptical frame 3 includes an upper continuous leaf spring portion 7, a forward lower leaf spring portion 9, and a rear lower leaf spring portion 8. The line 10 passes along the center of the lower leaf spring portions 8, 9. The axles 11, 12, 13, 14 are supported along line 10 in leaf spring portions 8 and 9. The wheels 15, 16, 17, 18 are supported by axles 11, 12, 13, 14 respectively. While the frames 3 are depicted in the various figures as aligned perpendicular to the bottom of the boot, it should be understood that they may be positioned at various angles relative to the boot, as well as relative to each other. For example, the upper leaf springs 7 of a pair of frame member 3, may be spaced closer together than the respective lower leaf springs 8, 9.

Overload protection posts 19, 20 extend upward from the lower leaf spring portions 8, 9. The overload protection posts 19, 20 hit either the upper continuous leaf spring portion 7 or the mounting blocks 4, 5, or both, under maximum load conditions. Under load, such as the weight of the skater or the force of the skater applied during push off, the open elliptical frame 3 flexes as indicated by arrows L1, L2, L3. The inner wheels 16, 17 are supported in the most flexible portion of the open elliptical frame 3 at the inside ends 21, 22 of the lower leaf spring portions 8, 9. This arrangement can provide a soft, comfortable ride for the skater. Additionally, the inside ends 21, 22 flex perpendicularly to the forward direction F of the skater. This flex can improve maneuverability by allowing an increased rocker distance d to be formed in the frame when the skate is unloaded. It will also be appreciated that the opening in the elliptical frame 3 need not be between the middle wheels 16 and 17. For example, the opening may be between the third and fourth wheels 15 and 16, or at other locations along the upper and lower leaf springs 7, 8, 9.

The open elliptical frame 3 is thickest at ends 23, 24 to provide the necessary overall structural strength to support the load of the skater. The open elliptical frame 3 thins out at points 25, 26 to provide a more even distribution of stress. Thus due in part to the varying cross-sectional shape of the frame and in part to the open frame design, the open elliptical frame 3 is stiffer at the outside wheels 15, 18 than the inside wheels 16, 17. As the load increases such as during the push off when the skater is pushing the skate against the ground, more of the load is transferred to the outer wheels, and the frame becomes stiffer. Also, since the inner wheels deflect more than the outer wheels, the rocker radius increases (i.e., the skate "flattens out") as the load increases. These are important characteristics for advanced skaters. The amount of rocker can be represented by distance d. The skate geometry and stiffness can be designed so that the skate flattens out (d=0) at a typical skater's push-off load. In this way all the wheels actively participate in the push-off, yet the skate has a rocker or curvilinear wheel alignment when initiating a turn for improved maneuverability and stability.

A function of mounting blocks 4 and 5 is to affix the frame to the boot in such a way that holes or other stress concentrators in the frame are not necessary. A second function is to provide walls (for columns) which play an important role in increasing the lateral/torsional stiffness of the skate. Thirdly, the flex properties of the frame can be varied by varying the length and/or position of the mounting blocks. Fourth, the mounting blocks can also accommodate a "bed" of rubber-like material to add more stiffness, rebound, and/or damping and thus reduce vibration even more. This can make the frame flex properties readily adjustable by the user.

Figure 2:
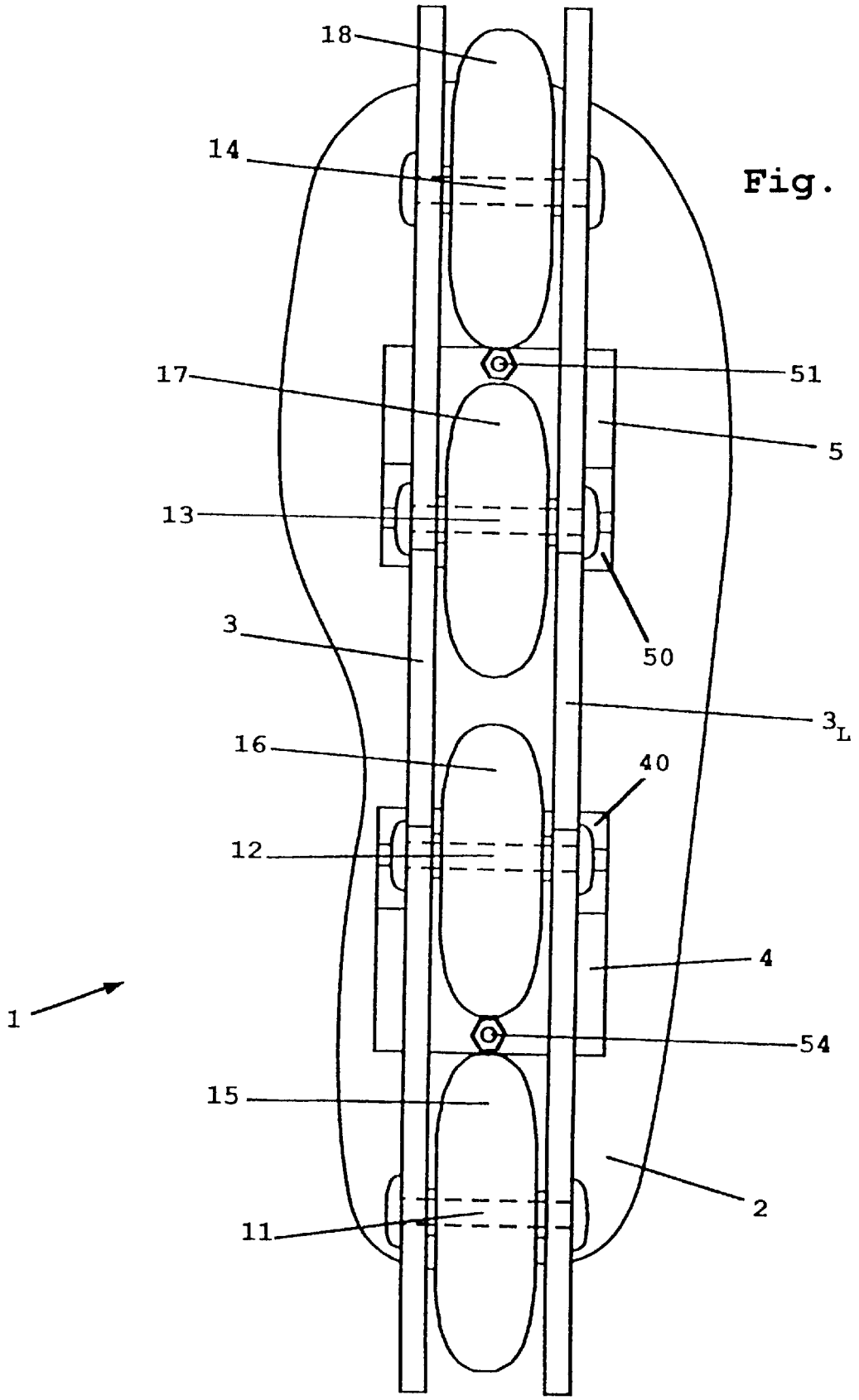
FIG. 2 is a bottom plan view of the preferred embodiment of FIG. 1.
Figure 4:
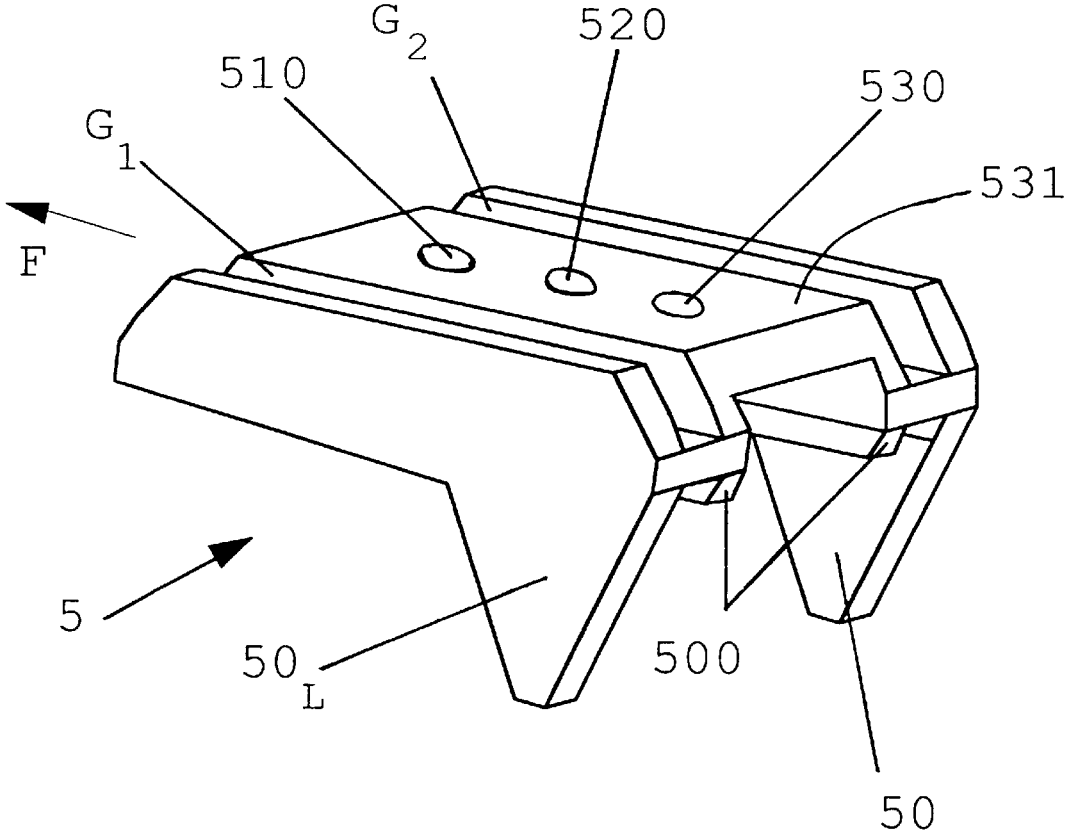
FIG. 4 is a perspective view of the mounting block of FIG. 1.

Referring next to FIG. 2 it can be seen that the open elliptical frame 3 is further comprised of a left frame member $\mathbf{3}_L$ and a right frame member 3. Members $\mathbf{3}_L$ and 3 may be identical, or may be mirror images, or may be asymmetrical. For example, inside member 3 may be stiffer than outside member $\mathbf{3}_L$. Mounting blocks 4, 5 hold the members $\mathbf{3}_L$ and 3 together in grooves $G_1$, $G_2$ as shown in FIG. 4. The axles 11, 12, 13, 14 provide the final support for the assembly $\mathbf{3}_L$, 3, 4, 5. Bolt(s) 51 mounts the mounting block 5 to the boot 2. Bolt(s) 54 mounts the mounting block 4 to the boot 2. A unique aspect of this construction is that the frame itself is not self-supporting—the axles and/or boot must be secured to support the frame.

Slightly increasing the depth of the slots $G_1$ and $G_2$ which accommodate the frame will make the clamping force of the mounting block entirely between the block and boot—no clamping pressure on the frame itself. In this way, the rear (preferable) or front mount can be made free to slide in the front to back direction while the other mount remains fixed in place. This will allow the frame to flex without flexing the boot, or reducing the flex of the boot. Adding a thin plate of low friction material such as teflon between the boot and the mounting block/top of frame will reduce the sliding friction at the top surface of the frame when the frame slides relative to the boot. Additionally, the mounting block can be made of, or coated with a low friction material (teflon-impregnated hard coat anodizing, if made of aluminum) to further reduce the sliding friction between the frame and the mounting block.

As further seen in FIG. 1, the mounting blocks 4, 5 have extensions 40, 50 which provide lateral and torsional support for the lower leaf spring portions 8, 9 via the overload protection posts 19, 20. Moving the mounting blocks 4, 5 toward or away from each other along the frame 3 provides an adjustable stiffness to the in-line skate 1. The closer the mounting blocks 4, 5 are to each other, the softer the frame. Relocation of the mounting block from the locations depicted in FIG. 1 may require modification of the extensions 40, 50 in order to maintain alignment with the protection posts 19, 20.

Figure 3:
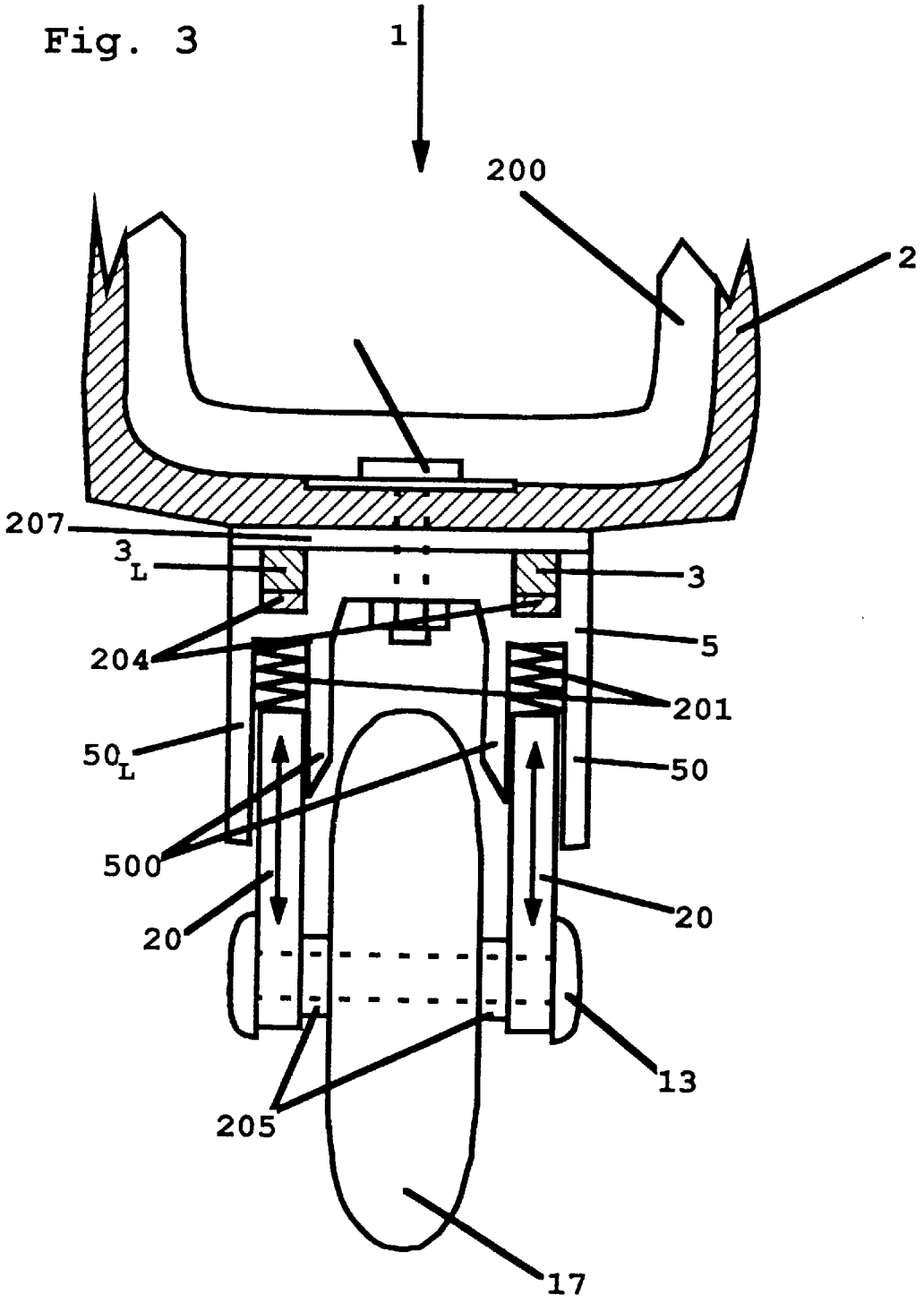
FIG. 3 is a sectional view taken along line 3—3 of FIG. 1.

Referring next to FIG. 3 the boot 2 has a liner 200. Extension 50 is mirrored in extension $\mathbf{50}_L$. Optional inside extensions 500 offer extra lateral stability for the in-line skate 1 if desired. Optional springs 201 offer extra shock absorption and adjustable stiffness if desired. Optional dampening material 204 offers extra damping if desired. The thickness of axle spacers 205 can be increased to further separate frame members 3 for various mounting blocks and/or wheel combinations. Optional damping pad 207 offers extra damping if desired.

Referring next to FIG. 4, holes 510, 520, 530 provide access for bolt(s) 51 of FIG. 2. Planar top surface 531 distributes the skater's load evenly and eliminates wear producing stress concentrations.

One function of the overload protection posts 19, 20 is to limit the frame's flex to a certain amount of travel, thus making it nearly impossible to break the frame under normal use. The longer the columns are, the shorter the maximum travel is. A second function is to work in conjunction with the "walls" of the mounting blocks in order to increase the lateral and torsional stiffness of the frame. Yet another function is to accommodate springs or other shock absorbing damping devices as shown in the embodiments of FIGS. 8–13 and 15–18. A further function is to allow adjustability of preloading the frame to provide variable performance characteristics to the user as shown in the embodiments of FIGS. 15–20 and 27.

Figure 5:
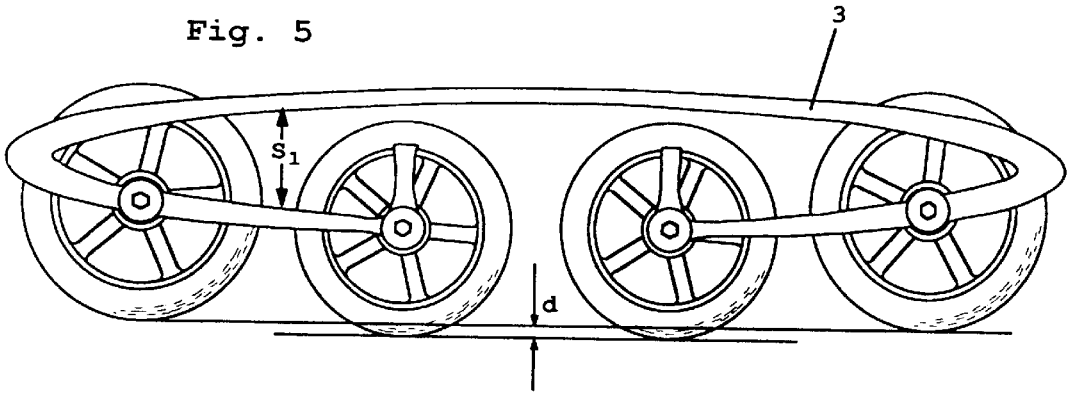
FIGS. 5, 6, 7 are right side plan views of the frame of the preferred embodiment of FIG. 1 with the mounting blocks removed shown in a sequence under unloaded, loaded, and overloaded conditions, respectively.
Figure 6:
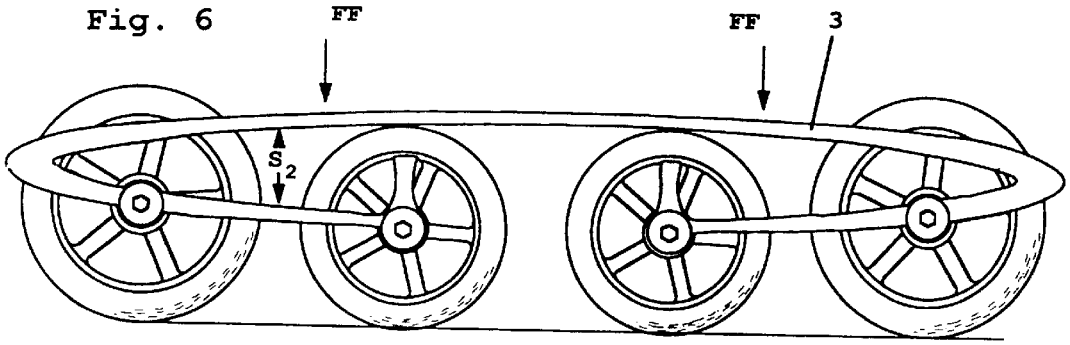
Figure 7:
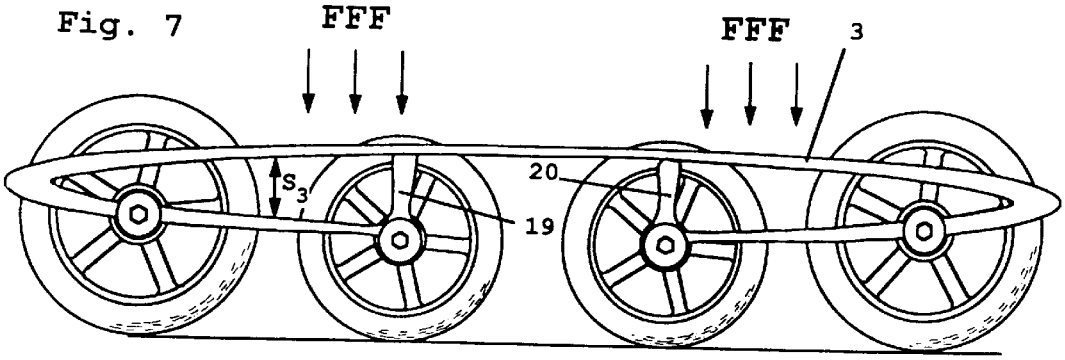
Figure 8:
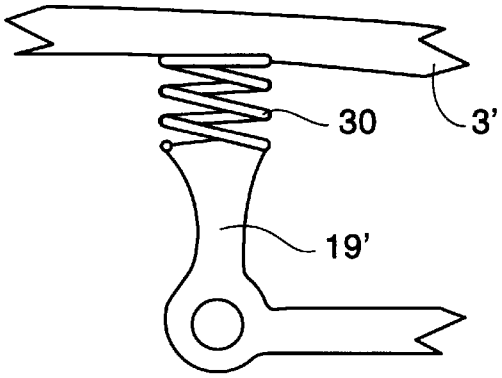
FIGS. 8 through 13 are right side plan views of alternate embodiments of overload protection post assemblies.

Referring next to FIGS. 5, 6, 7 the open elliptical frame 3 is seen in an undeflected state in FIG. 5. $S_1$ is maximal. Also, the rocker offset d is maximal. FIG. 6 shows $S_2$ at a smaller distance as the frame 3 flattens out and becomes stiffer by force FF. FIG. 7 shows a maximal force FFF forcing the overload posts 19, 20 against the frame 3. $S_3$ is minimal. The overload posts 19, 20 protect the frame 3 from breaking. It should be appreciated that the depicted deflection of the frame is illustrative and applies equally to the other embodiments, including the closed elliptical frames.

Figure 9:
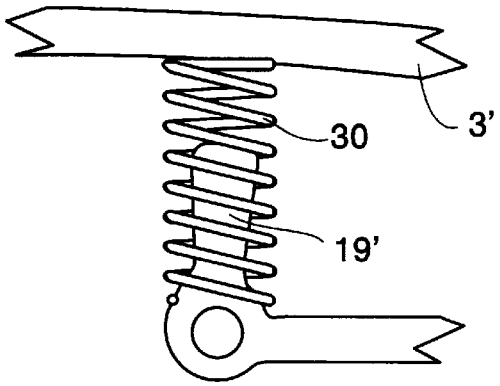
Figure 10:
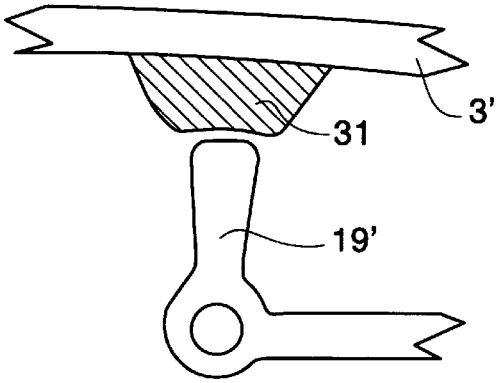
Figure 11:
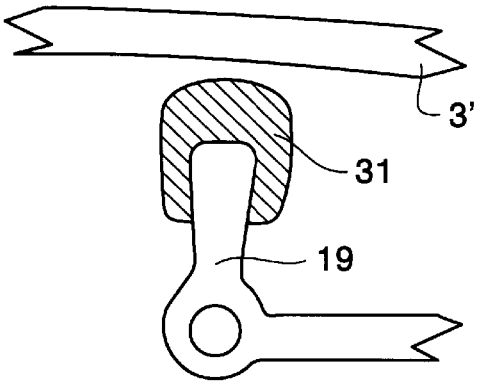
Figure 12:
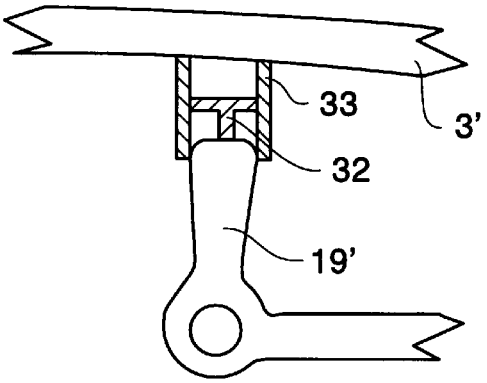
Figure 13:
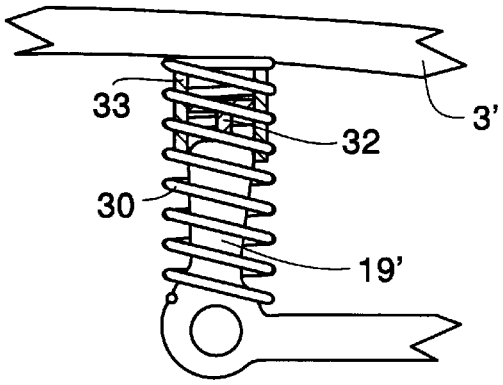

FIGS. 8–13 show various and further designs of overload protection assemblies some of which can also be used to make the frame stiffness/flex properties easily adjustable. With respect to FIG. 8, overload protection (OP) rod 19' forces spring 30 against frame 3'. In FIG. 9, OP rod 19' forces spring 30 against frame 3'. In FIG. 10, OP rod 19' forces resilient pad 31 against frame 3'. In FIG. 11, OP rod 19' forces resilient pad 31 against frame 3'. In FIG. 12, OP rod 19' forces shock absorber piston 32 up the cylinder 33 which is mounted on frame 3'. In FIG. 13, OP rod 19' forces spring 30 into the frame 3' and piston 32 into the cylinder 33. All of the embodiments dampen vibrations The embodiments of FIGS. 8, 9, 12 and 13 can change the force-deflection curve to make the frame stiffen with load, and increase the rebound. Preloading the frame allows the frame to absorb a higher load while skating and can increase the maximum flex range of the frame.

Figure 14:
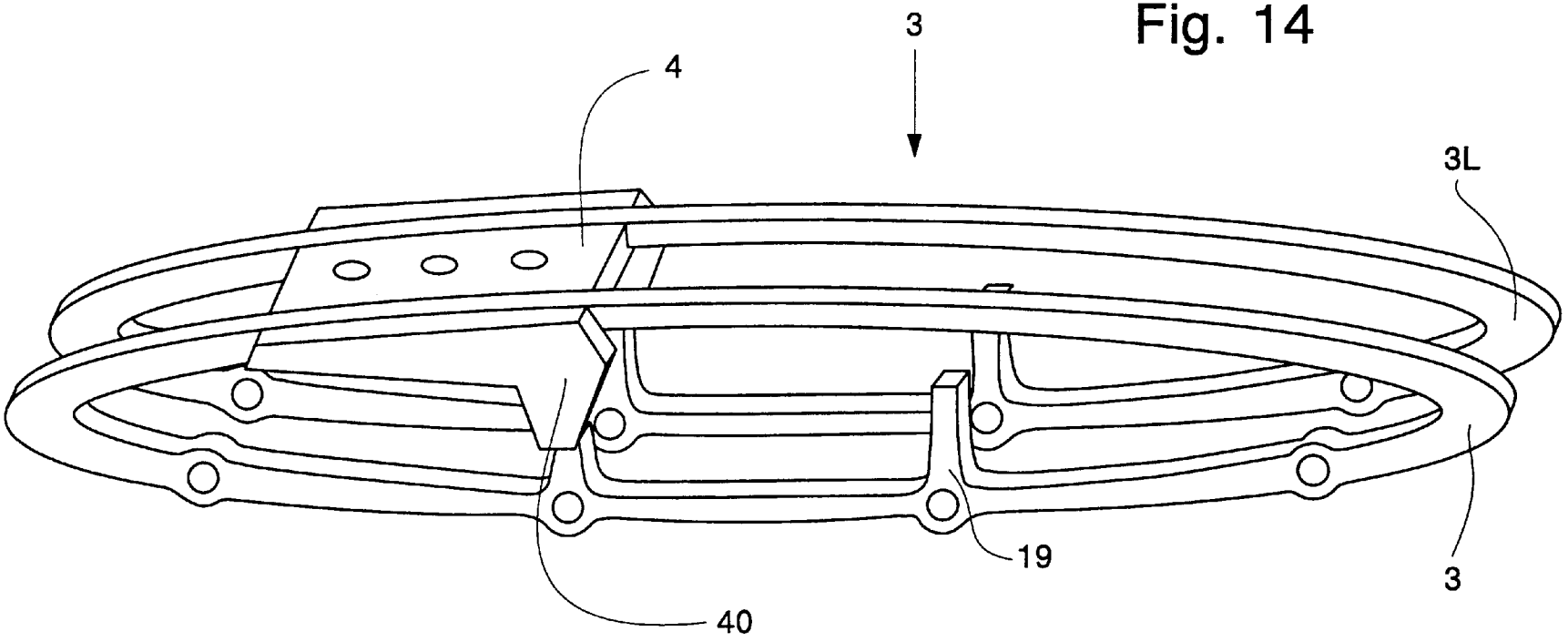
FIG. 14 is a perspective view of an alternate embodiment of a closed loop elliptical frame dismounted from the boot.

As an alternative embodiment the frame may be closed. Referring to FIG. 14, a closed loop elliptical frame 3" is shown. The same mounting block 4 is used. All functionality of the frame assembly are identical to the embodiment of FIG. 1. This embodiment offers a stiffer ride than the preferred embodiment of FIG. 1, with improved lateral and torsional stiffness, realized by closing the elliptical frame. The wheels are no longer suspended independently.

Figure 15:
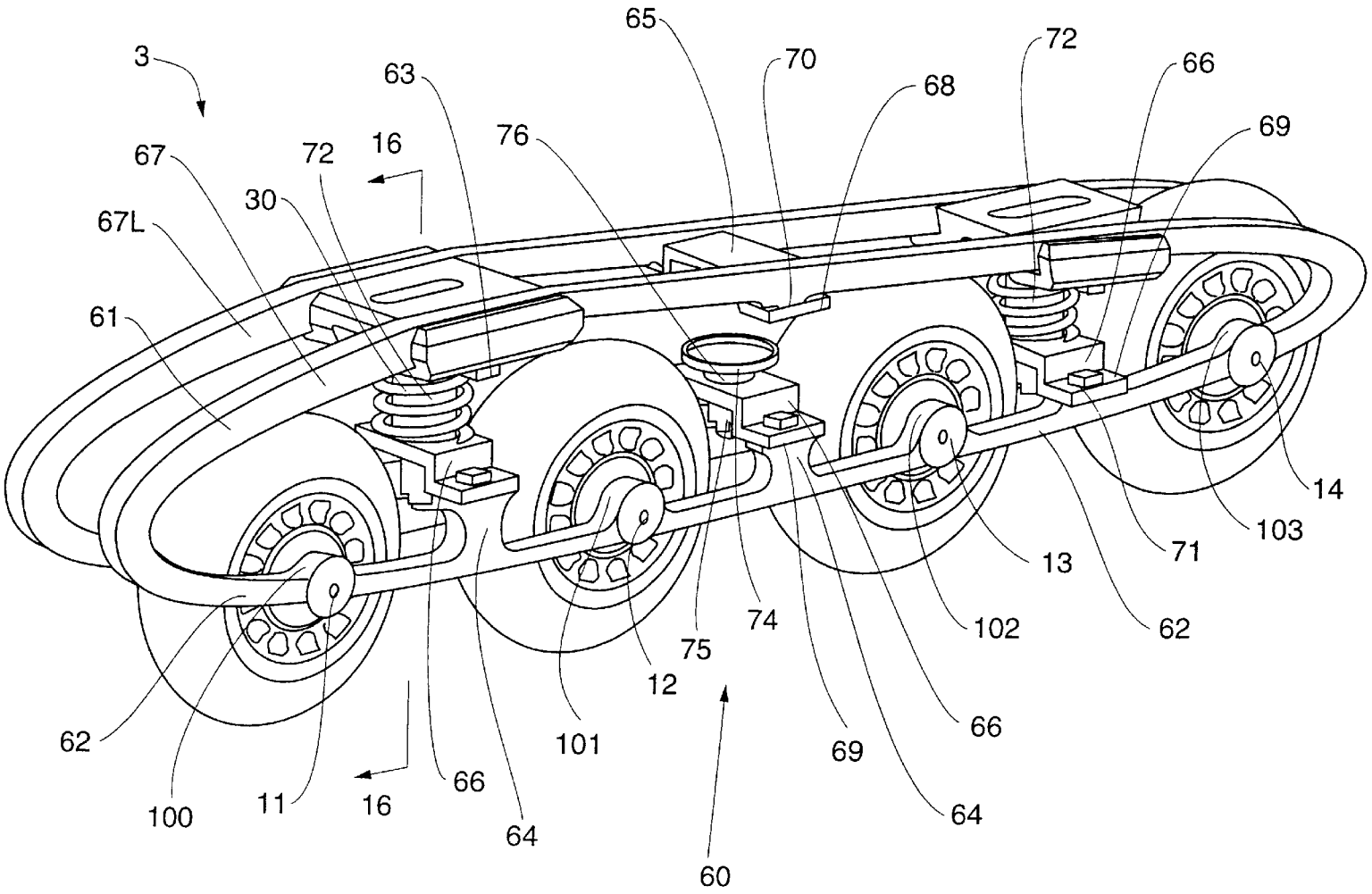
FIG. 15 is a perspective view of the frame of an in-line skate with a suspension system of the present invention.

Referring next to FIG. 15, a further alternative embodiment of a closed elliptical frame 3" is shown. This embodiment further includes a variable rocker or suspension system 60 which allows the profile of the rocker and the stiffness and preload of the frame to be adjusted to meet the performance needs of the skater. The upper and lower leaf springs 61, 62 are provided with inwardly directed mounting posts 63, 64. Upper and lower bridge members 65, 66, as well as mounting blocks 40', connect the two frame members 67, $67_L$ and are provided with base plates 68, 69 to abut the inside surfaces of the upper and lower leaf springs 61, 62. Guide slots 70, 71 formed in the baseplates 68, 69 receive the mounting posts 63, 64 to locate and align the upper and lower bridge members 65, 66. A spring or vibration damping device 72 is positioned between the upper and lower bridge members 65, 66, although the middle damping device has been removed for clarity of viewing other components. The mounting block 4' may substitute for the upper bridge member 65.

Figure 16:
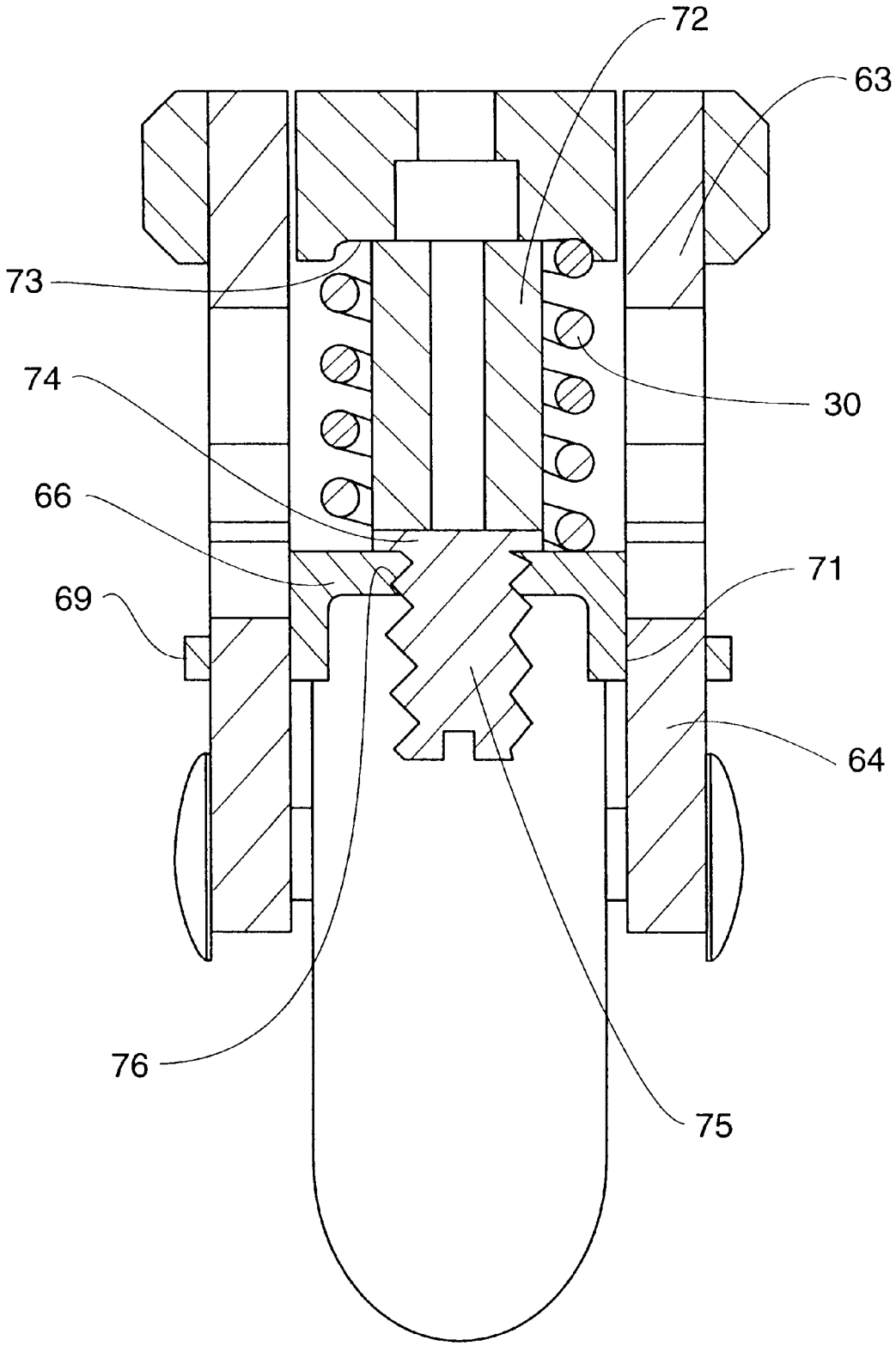
FIG. 16 is a cross sectional view of the suspension system shown in FIG. 15, taken along line 16—16 of FIG. 15.

With reference to FIGS. 15, 16, the upper portion of the damping device 72 is seated in a recess 73 formed in the upper bridge member 65. The lower portion of the damping device 72 is affixed to the lower bridge member 66 by a base 74 containing an elongated threaded member 75 received in a complementary female threaded member 76 disposed in the lower bridge 66. Adjustment of the elongated threaded member 75 spreads or reduces the distance between the upper and lower leaf springs 61, 62. In this way, the frame 3" may be preloaded as the skater desires. By the act of preloading the frame, the rocker or curvilinear alignment of the wheels may be increased. When the damping device 72 is a compressible urethane cylinder, this tends to make the frame stiffer, as urethane becomes stiffer the more it is compressed. Disk inserts (not shown) made of a low friction material such as teflon may be included between the damping device 72 and the base 74 so that turning the threaded members does not twist the damping material.

The damping device 72 may be a piece of resilient damping material such as elastomers, or certain kinds of microcellular foam or a conventional coil spring 30, or any combination of the above. These types of materials, including urethane or similar material, absorb high frequency vibrational energy associated with shocks and other "road buzz," and compress and return during low frequency dynamics such as upon push-off or on landing after a jump to provide good rebound characteristics. It has been found that urethane of a 55–60A durometer rating provides all around desirable characteristics. Of course, performance characteristics will vary depending upon the subjective requirements of individual users who may prefer different hardness levels.

Figure 17:
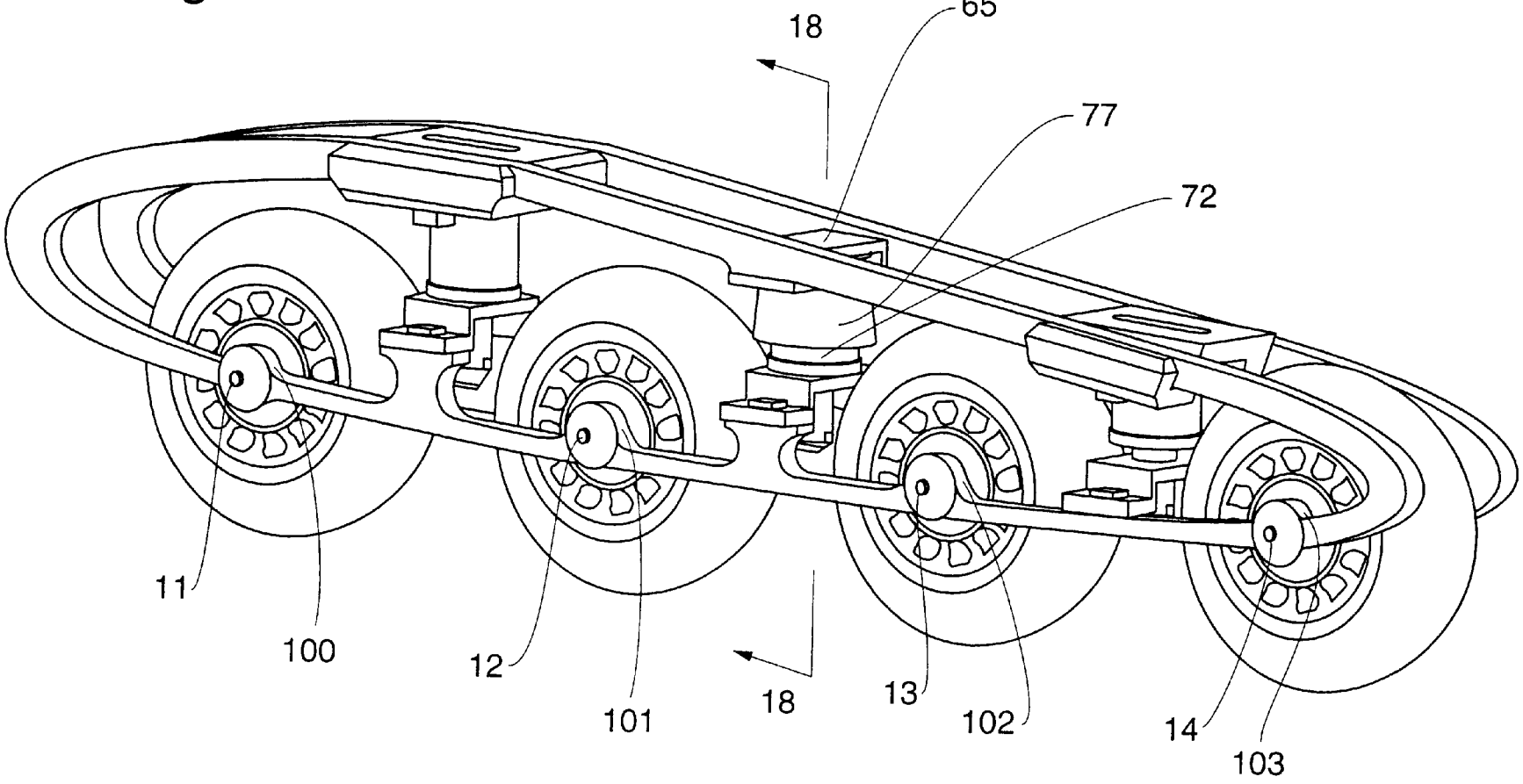
FIG. 17 is an alternative embodiment of the suspension system.
Figure 18:
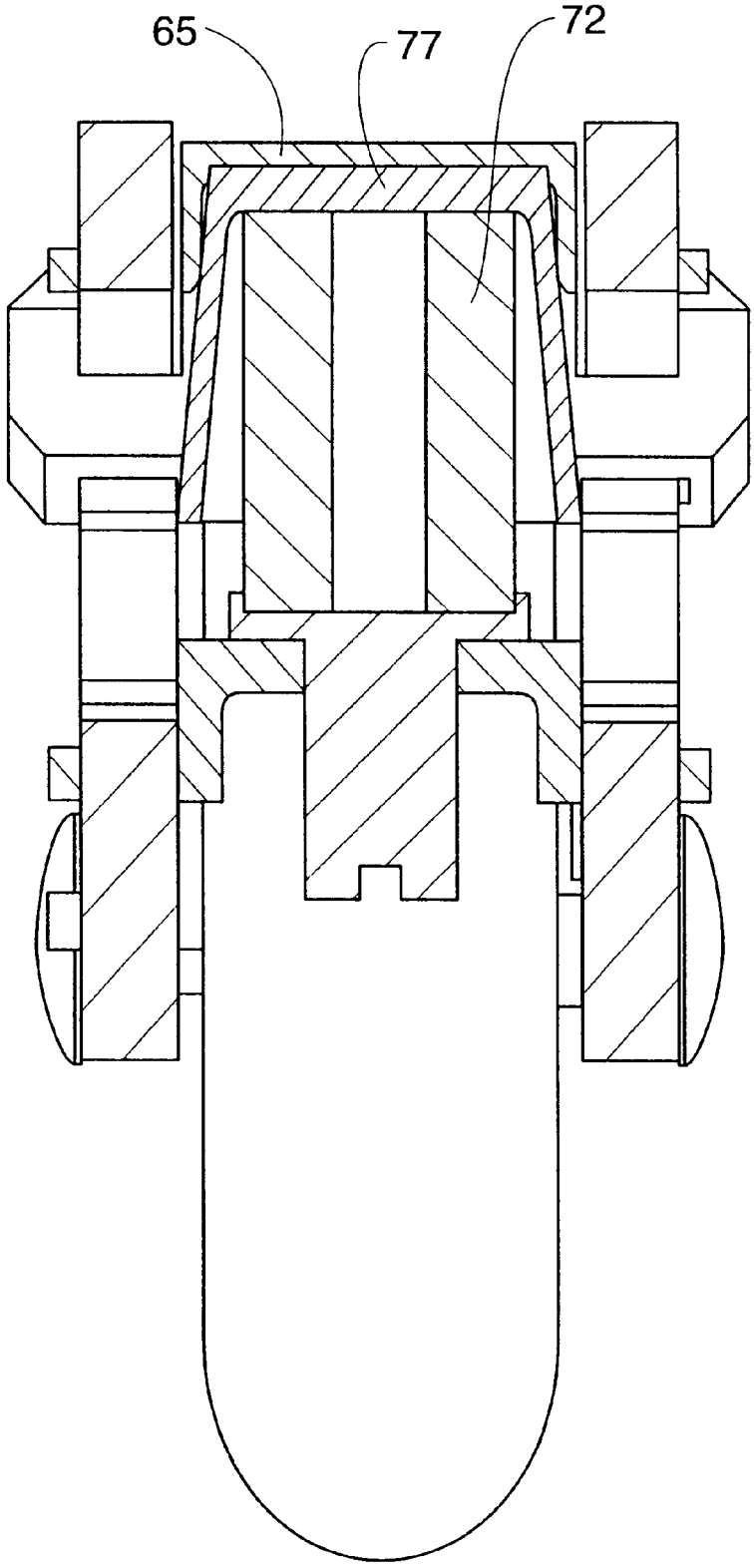
FIG. 18 is a cross sectional view of the suspension system shown in FIG. 17, showing a damping device and constraint cup, taken along line 18—18 of FIG. 17.

FIGS. 17, 18 show yet a further embodiment of the suspension or variable rocker system. Here, the center damping member 72 is seated in a constraint cup 77 affixed to the upper bridge member 65. The inside surface of the constraint cup acts to control the deflection of the damping device in a planned or intended manner. This can be used to create a frame that becomes stiffer the more it is compressed or preloaded. In this way, advantage can be made of the compression characteristics of elastomers or other damping materials. This means that a skate frame is softer or more pliant when used by a light or non-aggressive skater or when countering high frequency road buzz, but stiffer when used by a heavier or aggressive skater, such as absorbing impact following jumps and other stunts. It will be appreciated that the constraint cup 77 may be attached to the mounting block 4' rather than the upper bridge member 65, or that the entire suspension system 60 be turned 180° so that the cup 77 is on the bottom. It should also be appreciated that any combination of various suspension system embodiments may be combined with any frame.

Figure 19C:
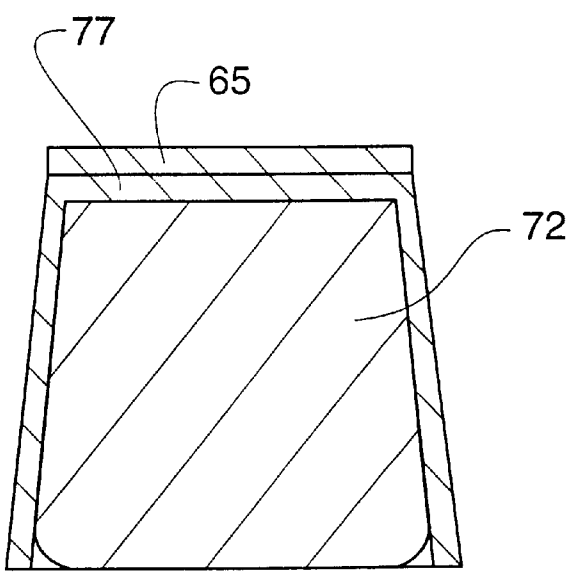
FIG. 19 A–C are partial cross sectional views of the damping device and constraint cup of FIG. 18 shown during activation.
Figure 19B:
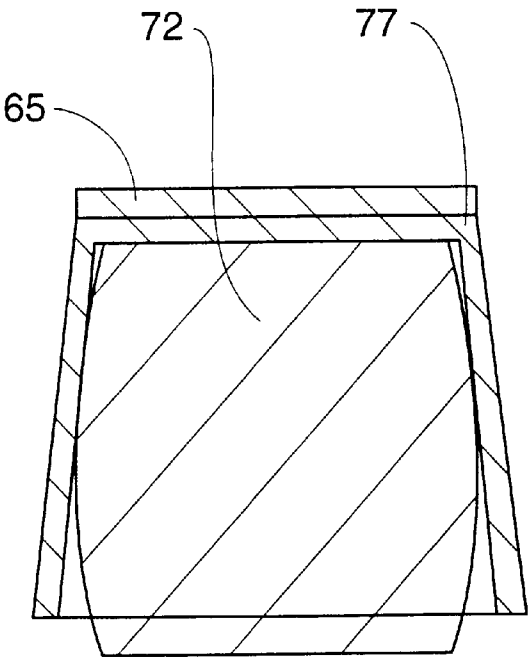
Figure 19A:
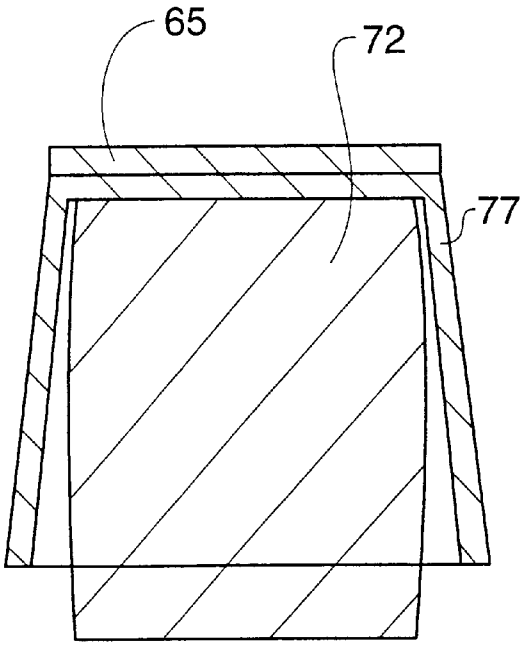
Figure 20B:
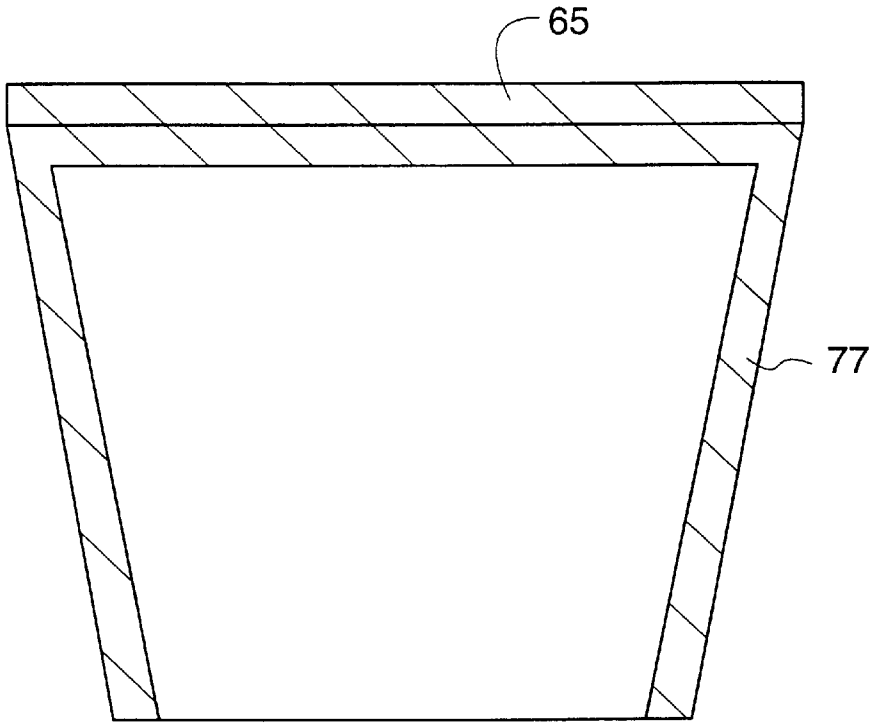
FIG. 20 A and B are cross sectional views of alternative embodiments of the constraint cup.
Figure 20A:
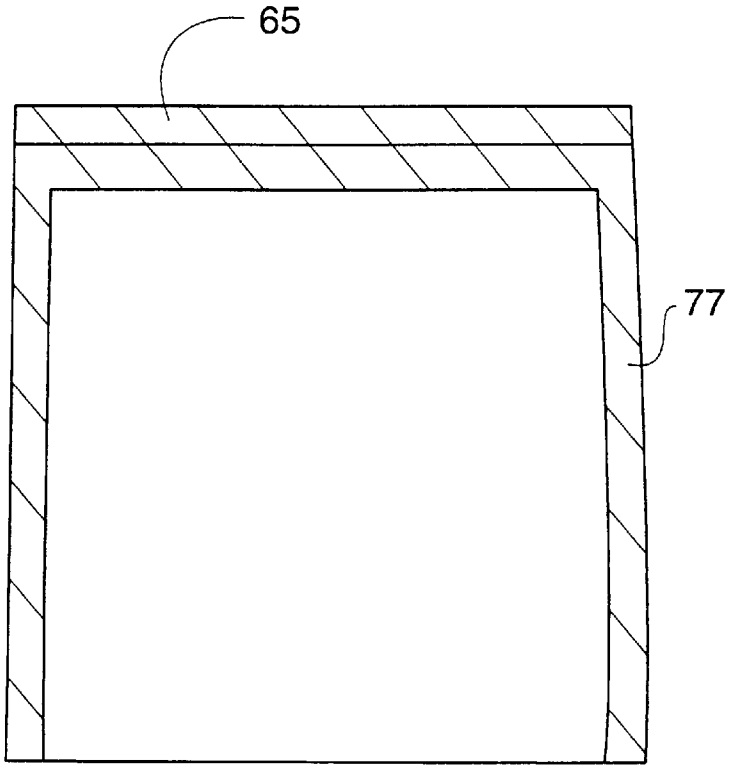

The constraint cup works as follows. Because urethane or other similar damping materials are essentially incompressible, it must bulge or deform when compressed. The inside profile of the constraint cup can control the amount and rate of deformation. As depicted in FIGS. 19 A–C, as the damping device is compressed and begins to bulge (FIG. 19 A), it progressively contacts the inside surface of the constraint cup 77 (FIG. 19 B) Stated differently, the constraint cup 77 progressively constrains more and more of the damping device 72, making it stiffer and stiffer, until the damping device 72 cannot be further compressed (FIG. 19C). The profile of the constraint cup 77 determines how quickly the stiffness of the damping material increases, as well as its maximum compression. It may be desirable to use a softer urethane (e.g., 45–55A durometer) in combination with the constraint cup 77 than would be used without the constraint cup 77. Alternative embodiments of the constraint cup, which will vary the responsiveness and performance of the suspension system, are shown in FIGS. 20 A and B. Changing the profile of the constraint cup changes the rate at which the cup constrains the deformation of the damping device, and thereby changes the rate at which the device becomes stiffer. For example, the profile shown in FIG. 20A will constrain the damping device more quickly than the profile shown in FIG. 20B.

Figure 21:
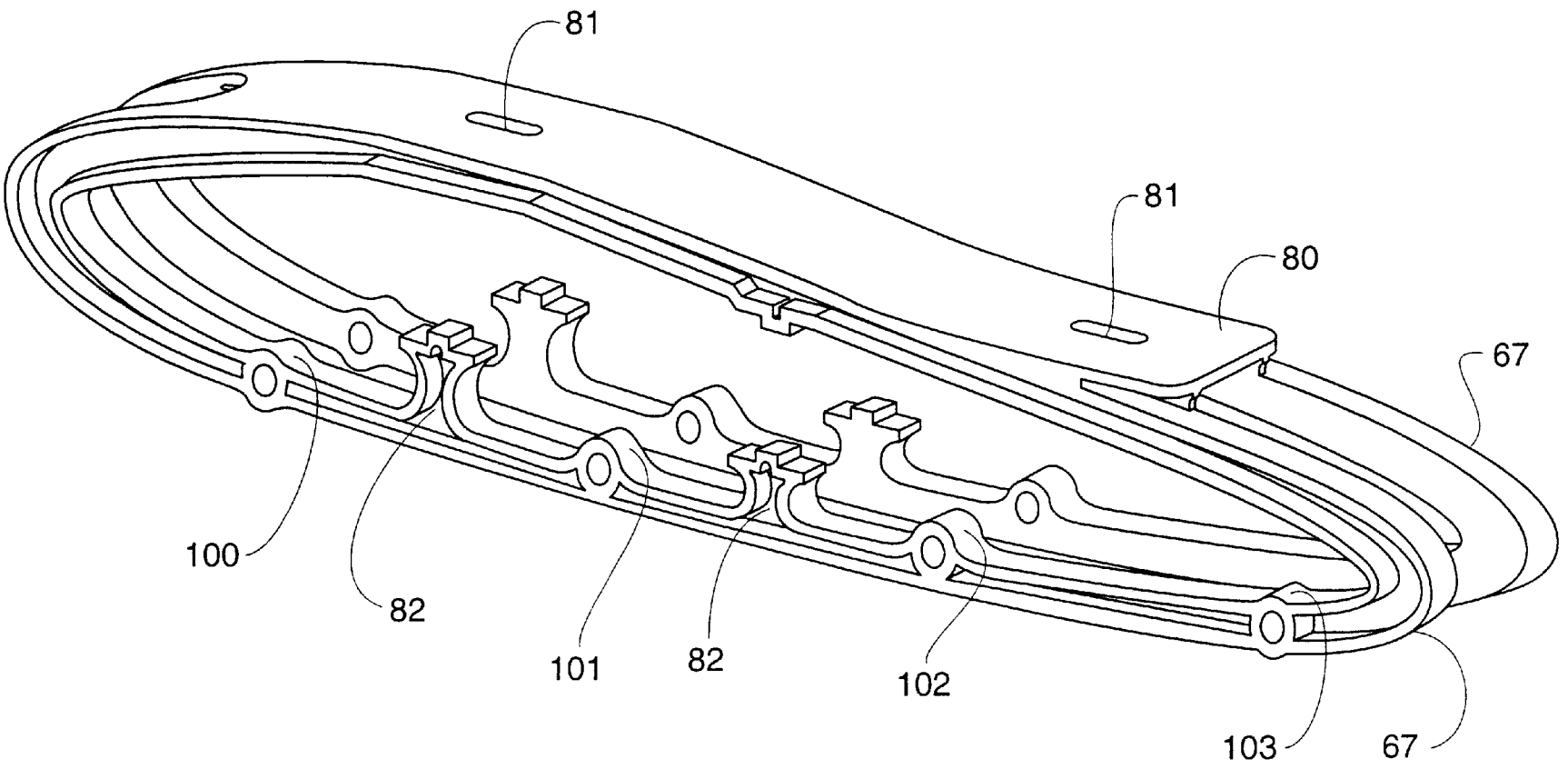
FIG. 21 is a perspective view of a one-piece molded frame of the present invention.
Figure 22:
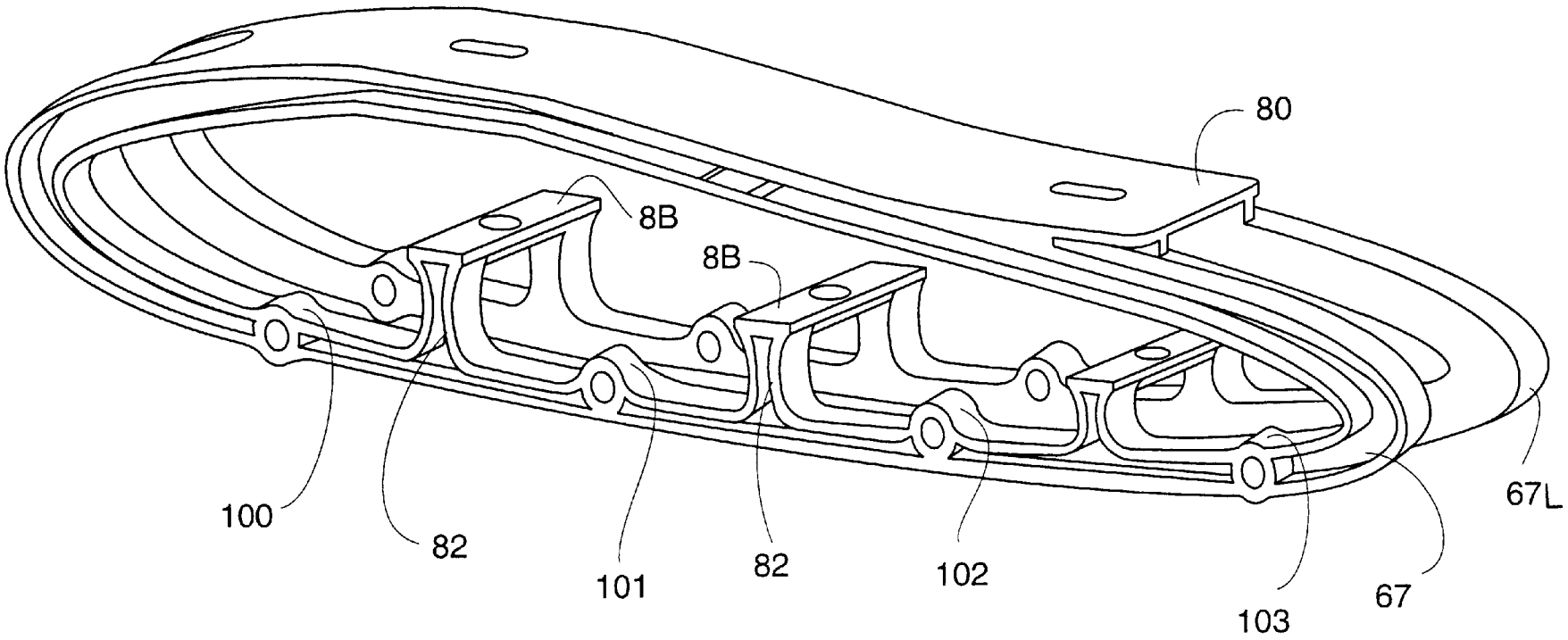
FIG. 22 is an alternative embodiment of a one-piece molded frame for an in-line skate.

Another feature of the present invention is the recognition of the advantages of heel lift to performance, and incorporation of varying structures to achieve this benefit. In general, heel lift provides the advantages of a more efficient skate stride and transfer of energy between the skater and the flexible frame. This, in turn, provides enhanced rebound. Referring to FIGS. 21 and 22, the desirable characteristics associated with a heal lift can be designed into a one-piece frame construction. As shown, the frame includes a pair of rails 67, $67_L$ integrally joined by an upper bridge member 80 which serves to attach the boot to the frame. The upper bridge member is provided with slots 81 to accept boot attachment members, and the slots are longitudinally disposed to allow for flexibility in positioning the boot relative to the frame. As shown, the upper bridge member 80 may be constructed with a profile which follows the contour of the boot or may be provided with a built-in heel lift.

The one piece construction may include lower mounting posts 82 for receiving separate bridge members 83 (FIG. 21), or the mounting posts 82 may include integral bridge members 83' (FIG. 22). Integrating both upper and lower bridges (FIG. 22) also serves to increase the lateral and torsional stiffness.

Figure 23:
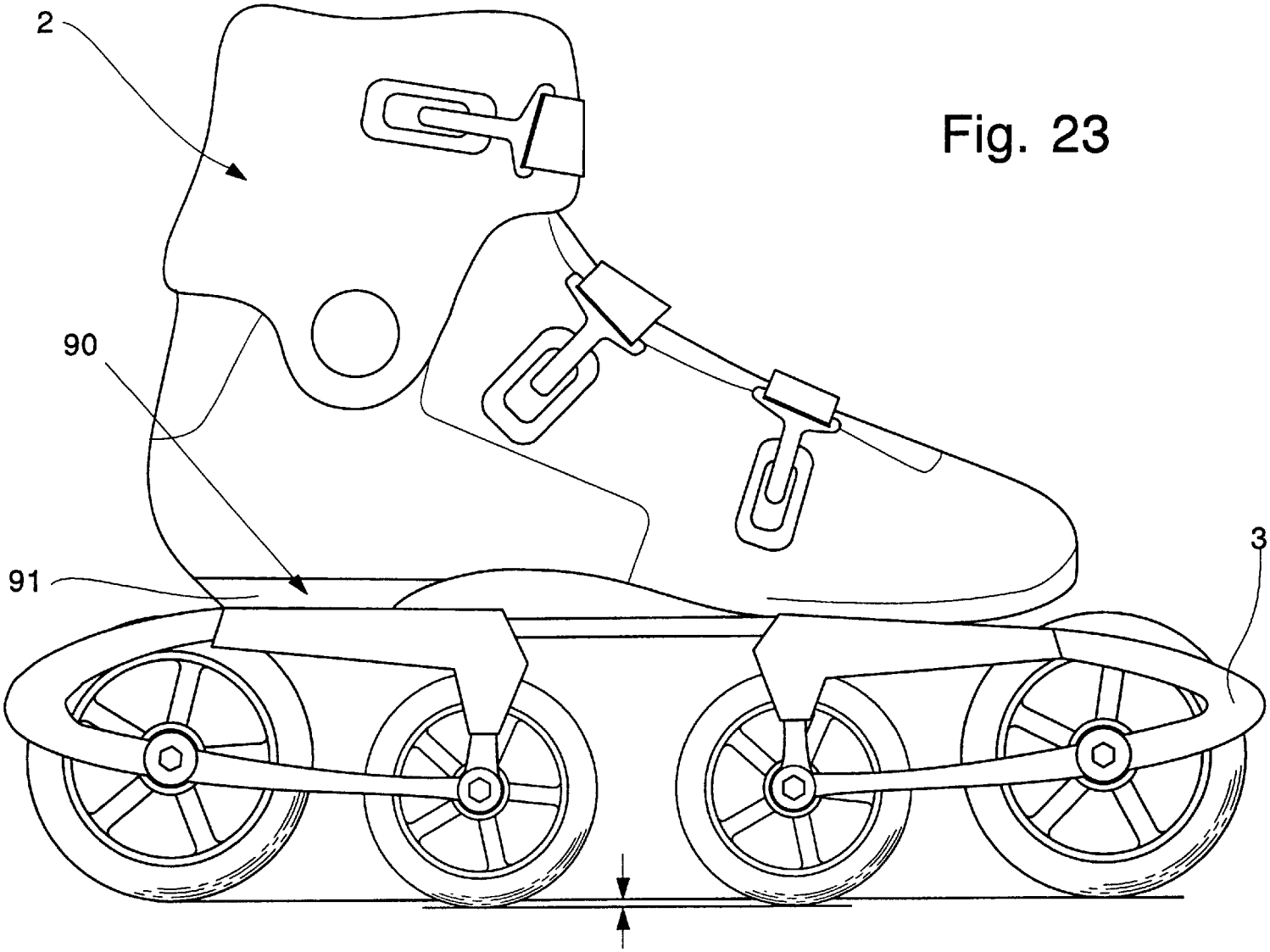
FIG. 23 is a right side plan view of yet another alternate embodiment having a non-symmetrical open ellipse design.

Referring to FIG. 23 a skate has a boot 2 mounted on a frame 3. The frame 3 is based on the open ellipse of FIG. 1, but is non-symmetrical. The high point of the frame is at 90 under the heel 91 of the boot 2. This design eliminates the need for a separate heel lift.

Figure 24:
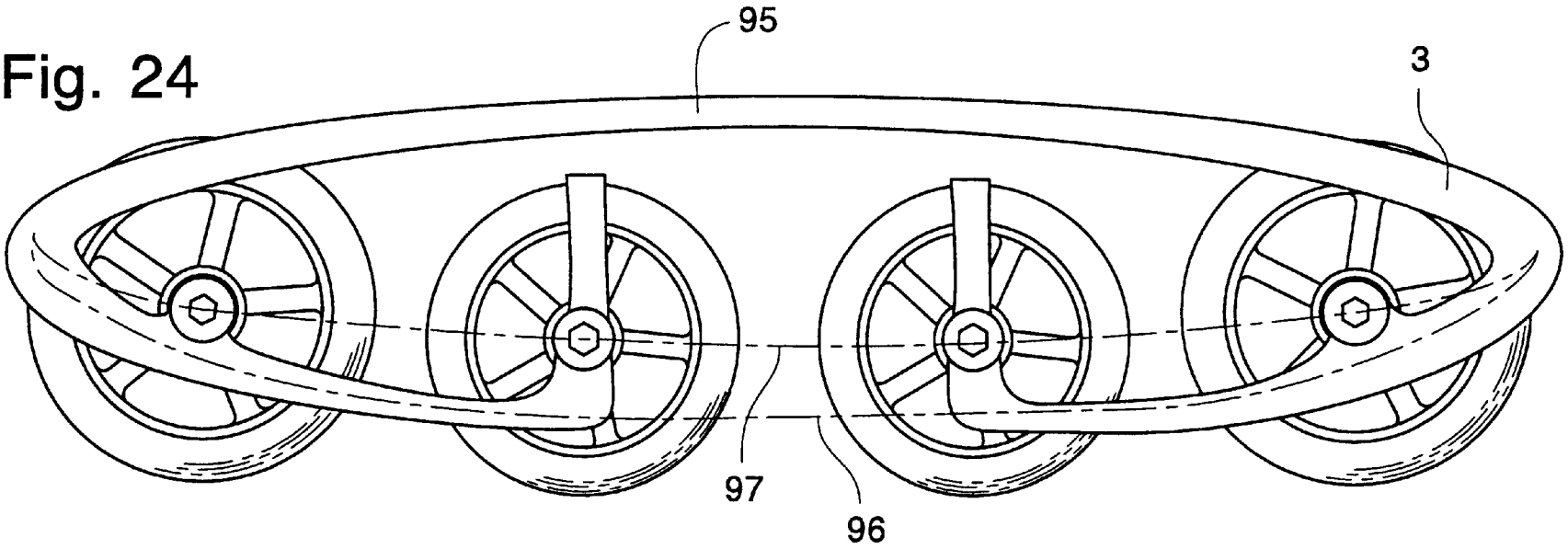
FIG. 24 is a right side plan view of yet another embodiment of an open loop elliptical frame having off-center axle mountings.
Figure 25A:
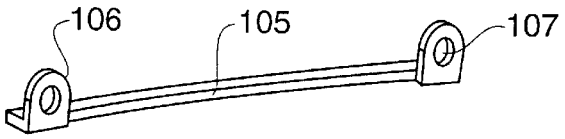
FIG. 25 A–D are perspective views of three different embodiments of frame stiffeners of the present invention.
Figure 25B:
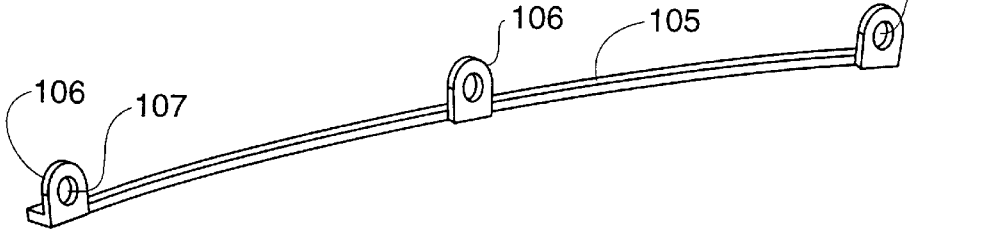
Figure 25C:
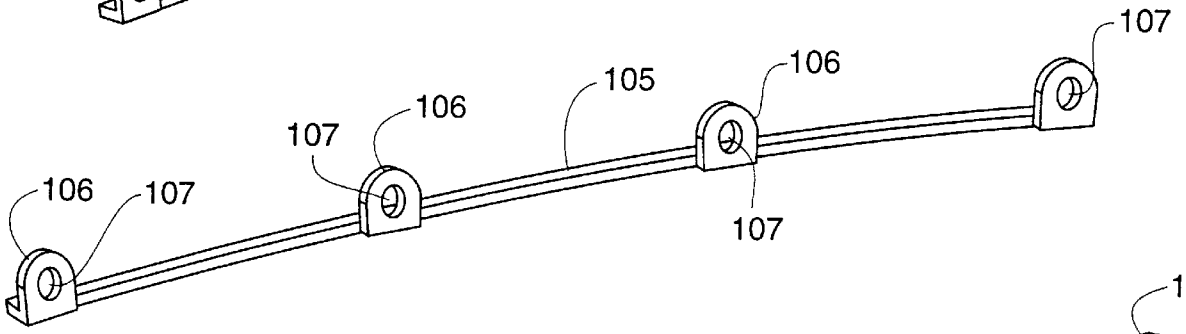
Figure 25D:
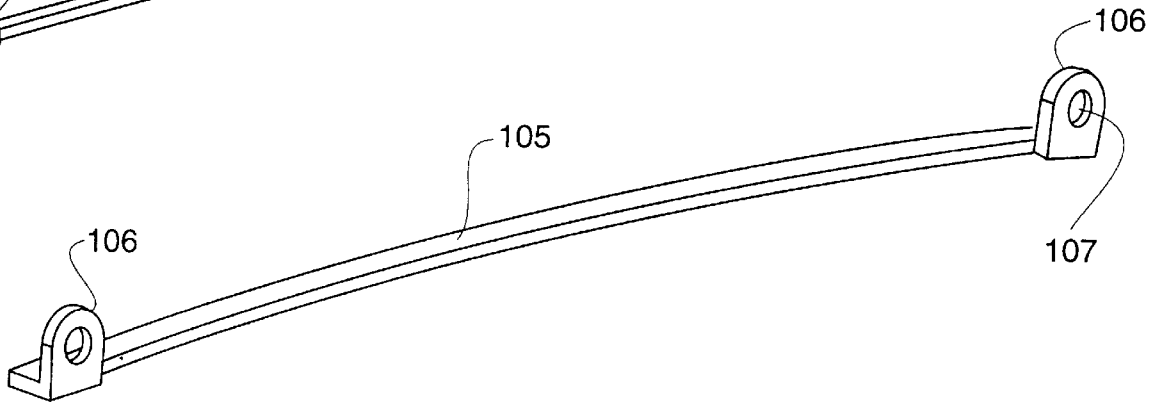

Referring next to FIG. 24 a frame member 3 is shown that features a lower height for the top of the elliptically shaped frame at 95. The axles are mounted above the bottom half of the elliptical center line 96 at a higher mounting line 97. This embodiment is useful for large ellipses which otherwise would tend to raise the skater too high off the ground.

Varying the alignment of the wheel axles relative to the centerline of the frame can also vary performance characteristics. As seen in the embodiment of FIG. 1, the axle for each of the respective wheels 11, 12, 13, 14 is aligned with the centerline of the lower leaf springs 8, 9 of the frame. In contrast as shown in FIGS. 15, 17, 21 and 22, the axles of the end wheels 11, 14 are disposed in bushings 100, 103 that are aligned with the centerline of the frame, while the axles for the middle or inner wheels 12, 13 are disposed in bushings 101, 102 positioned above the centerline of the frame. Thus, the curvature of the frame may be increased or decreased, while maintaining an acceptable rockered or curvilinear alignment for the wheels i.e., one in which the center of curvature is above the wheels. Similarly, the curvature or alignment of the wheels may be varied while maintaining the curvature of the frame. It will be appreciated that the bushings may be variably positioned relative to the centerline of the frame, either above, below or in varying combinations in order to effectuate desired performance characteristics while maintaining an acceptable rocker or curvilinear profile during turning and an acceptable linear profile during straight line skating. Thus, the frame may be provided with an exaggerated curvature or a more linear profile independent of the positioning of the wheels.

It can been seen that the elliptical frame can be constructed from one piece bars that can be economically produced by stamping, fineblanking, or molding. It can also be seen that a variety of different stiffness frames can be readily adapted to the same boot. While the elliptical frame is shown in FIGS. 1, 14 and 15 as a bar with a rectangular cross section any cross sectional shape may be used, such as circular, oval, tubular, hollow, rectangular and non-symmetrical shapes. Non-symmetrical shapes in which the left and right bars are mirror images may be useful. For example, a trapezoidal shape in which the bar height is greater on the inside than on the outside. A laminated construction, such as with skis, may also be attractive. Varying the cross-sectional shape along its length can more evenly distribute the stress along the length of the bar based on a given design load. This can maximize the amount of flex achievable while keeping the maximum stress below a given level. For a rectangular cross section bar, this includes varying the height and depth of the bar both independently and in concert. The shape of the inside and outside bars of a single skate can be different as well. It may be useful to make the inside bar slightly stiffer than the outside bar as the skater's push-off tends to be stronger here.

Alternatively, the frame may have an I-beam or C-beam (FIGS. 21, 22) cross-sectional shape, which may also vary in size to improve performance, increase lateral and torsional stiffness, and reduce stress on the frame. The I-beam or C-beam cross section shown in FIGS. 21 and 22 allows the cross-sectional shape to taper, as discussed above, while maintaining a relatively constant wall thickness In addition, frame stiffeners 105, as shown in FIGS. 25 A–D may be retrofitted to the frame to modify performance characteristics. The stiffeners 105 include mounting brackets 106 spaced apart distances which conform to the distance between wheel axles. Each mounting bracket includes an aperture 107 to receive an axle bolt (not shown) The stiffness of the stiffeners 105 can be designed with varying degrees of rigidity, stiffness or curvature and can be connected between 2, 3 or more wheel axles, on one or both frame members, as desired. The stiffeners can be made from metal, plastic or composite material such as fiberglass.

Figure 26:
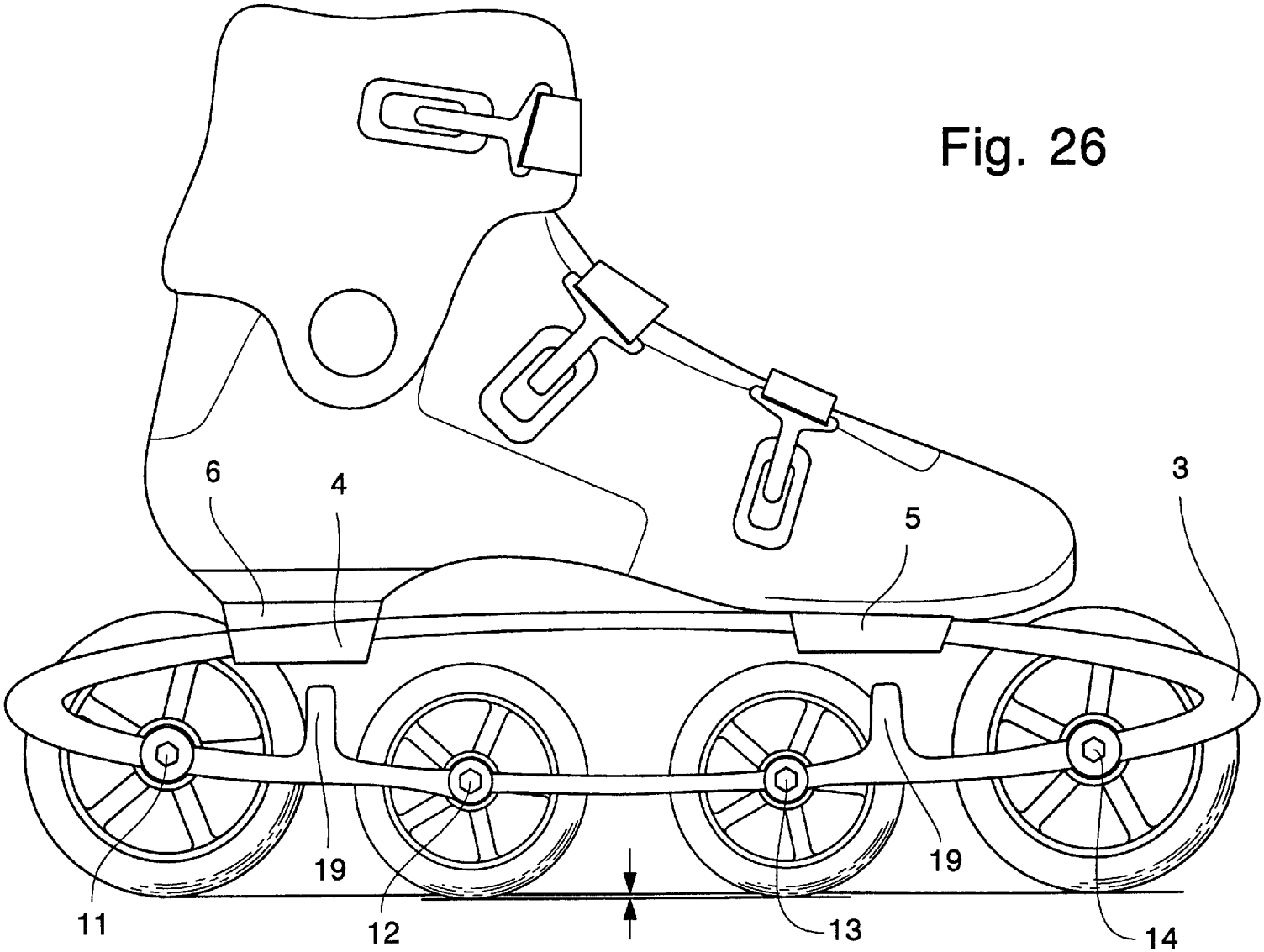
FIG. 26 is a right side plan view of yet another embodiment of a closed loop elliptical frame having overload protection posts directly below the mounting blocks.
Figure 27:
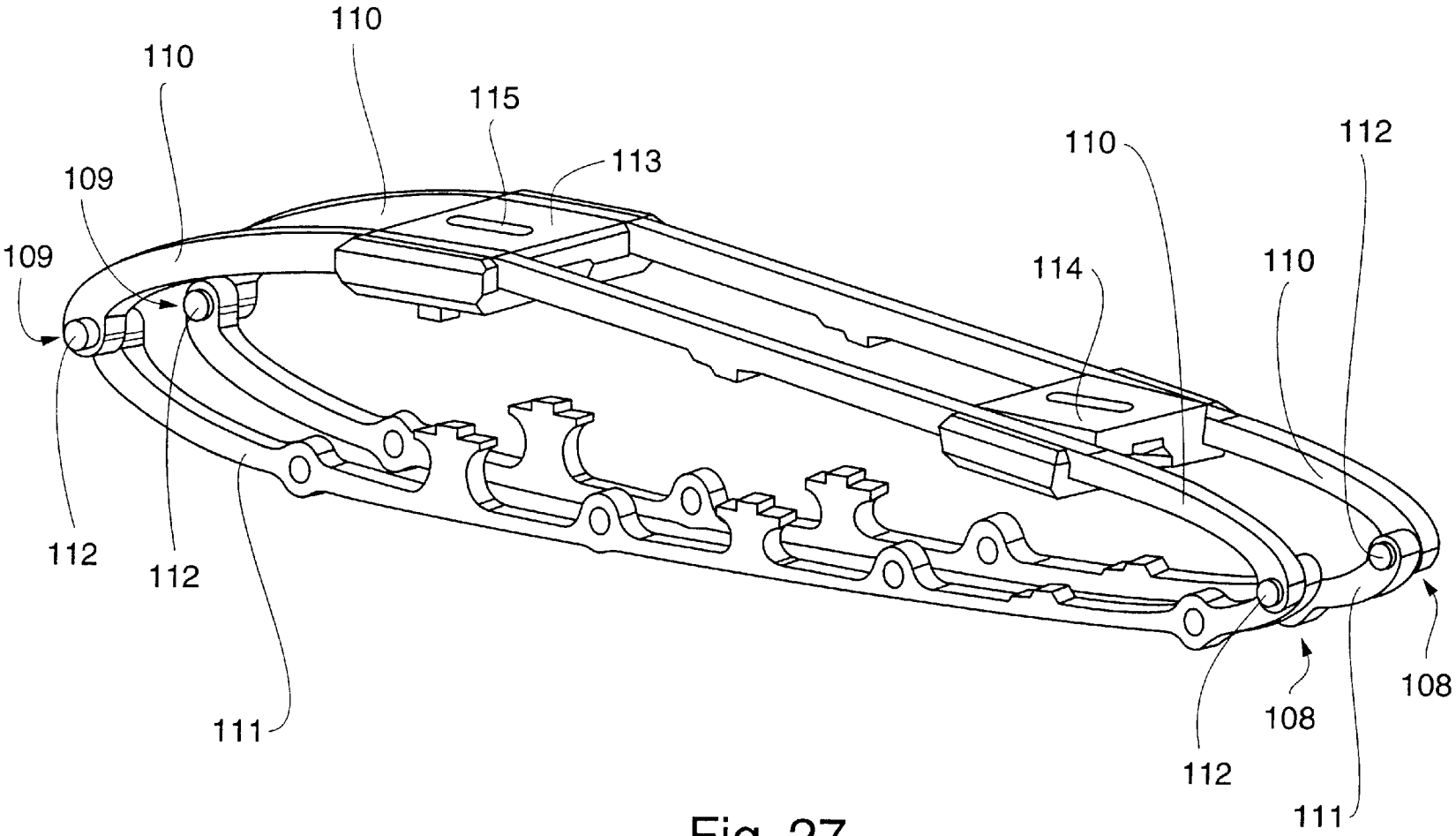
FIG. 27 is a perspective view of an alternative embodiment of the frame of the present invention.

FIG. 26 discloses yet a further closed loop embodiment. Frame member 3 is supported by axles 11, 12, 13 and 14. Mounting blocks 4, 5 serve to stop overload protection posts 19 which are located between the axles rather than over the axles. An optional heel elevator 6 is shown A still further embodiment is shown in FIG. 27. The junctions 108, 109 between the upper leaf spring 110 and lower leaf springs 111 may be a pivot or hinge, rather than a single continuous member as shown in FIG. 1. The upper leaf spring 110 and lower leaf spring 111 are joined by a pivot pin 112 at the leading and trailing edge of the frame. As the frame flexes under the conditions of skating, the junction of the upper and lower leaf springs at the pivot point 112 allows the frame to flex with a different distribution of load and stress and, thus, suspension characteristics. It may also be desirable to allow one of the mounting brackets 113, 114 to slide relative to the boot by allowing one of the mounting bolts (not shown) to reciprocate within slot 115.

In summary, the stiffness/flex properties of the frame are adjustable in at least the following ways:

1. Mounting block positioning—changing the boot mount location affects the stiffness of the frame. Moving the mounts in towards the center reduces the frame stiffness while moving the mounts outward towards the front and back increases the frame stiffness.

2. The length of the mounting block(s) can be increased or decreased to allow the frame to flex less or more. In the extreme, a single one-piece mounting block can be used. The stiffness of the mounting block itself can also be varied.

3. An adjustable suspension system may be combined with the frame to vary stiffness and flex properties. For example, springs can be used between the top and bottom of the frame or between the frame and the overload protection posts. Springs of different stiffnesses can be readily interchanged to vary the frame stiffness. These springs could also simply be a piece of resilient material such as rubber or urethane, or shock absorbers such as oil or compressed air type shocks. These shocks are common on automobiles and now on mountain bikes as well. In addition, these springs or damping devices can be made to be adjustable.

4. Stiffeners such as posts or strips of material can be fixed to the frame, preventing or reducing flex in certain parts of the frame, and thus stiffening the frame.

The frame has a different stiffness with respect to a load on the inside wheels versus the outside (front and rear) wheels. The frame is stiffer with respect to a load on the outside wheels than with respect to a load on the inside wheels. Varying the cross sectional shape of the frame affects these two stiffnesses. There are two important ramifications of these two different stiffnesses:

the inner wheels deflect more than the outer wheels, so the rocker of the skate decreases (frame flattens out) with increasing load;

as the load increases and the frame flattens out, more load is put on the outside wheels, and thus, the frame becomes stiffer as the load increases.

Although the present invention has been described with reference to preferred embodiments, numerous modifications and variations can be made and still the result will come within the scope of the invention. No limitation with respect to the specific embodiments disclosed herein is intended or should be inferred.

What is claimed is:

1. In an in-line skate having a boot and a pair of frame members subtending the boot, the frame members supporting a plurality of aligned wheels, a suspension system comprising:

a. upper and lower bridge members extending between the frame members, said upper and lower bridge members vertically aligned and spaced apart to define a gap therebetween; and, b. a spring member positioned between said upper and lower bridge members.

2. The suspension system of claim 1, further comprising adjustment means for varying the gap between said upper and lower bridge members.

3. The suspension system of claim 1, wherein one of said bridge members includes a seat to restrain movement of said spring member.

4. The suspension system of claim 1, wherein said spring member comprises a coil spring.

5. The suspension system of claim 1, wherein said spring member comprises a block of elastomeric material.

6. The suspension system of claim 1, wherein said spring member comprises a block of microcellular foam material.

7. The suspension system of claim 1, further comprising a restraining member positioned at least partially about the periphery of said spring member to influence the compression of said spring member.

8. The suspension system of claim 1 wherein said frame members are substantially parallel.

9. The suspension system of claim 1, wherein said suspension system becomes stiffer as a load upon said suspension system increases.

10. A skate suspension system for storing and recovering energy, comprising:

a. a frame having a pair of laterally spaced members for supporting the axles of a plurality of wheels;

b. said members moveable by deflection under a skating load between a first position wherein said wheels are in a rockered curvilinear alignment and a second position wherein said wheels are in a different alignment;

wherein, when said members move from said first position to said second position said members store energy, and when said members move from said second position to said first position said members release energy.

11. The skate suspension system of claim 10, further comprising at least one spring member operatively associated with said members such that said spring member stores energy when said members move from said first position to said second position and releases energy when said members move from said second position to said first position.

12. The skate suspension system of claim 10, wherein said laterally spaced members are parallel along part of their length.

13. The skate suspension system of claim 10, further comprising bridge members extending between said members.

14. The skate suspension system of claim 13, wherein said spring members are disposed between a pair of aligned bridge members.

15. The suspension system of claim 11, wherein the range of compression of said spring member is adjustable.

16. A suspension apparatus for a skate, comprising:

a. a frame including a pair of support members, one of said pair of support members positioned on each side of and supporting a plurality of wheels;

b. each of said support members further comprising an upper leaf and a lower leaf;

c. a mounting bracket disposed between said upper leaf of each of said members for affixing said frame to a boot; and d. at least one overload protection member disposed on said frame to prevent overstressing of said frame under a maximum load.

17. The suspension apparatus of claim 16, wherein said upper leaf of each of said support members is hingedly connected to said lower leaf of said support member.

18. The suspension apparatus of claim 16, wherein said support members and said mounting bracket are of one piece construction.

19. The suspension apparatus of claim 18, wherein a wall thickness of said one piece construction is substantially constant.

20. The suspension apparatus of claim 16, wherein said support members are parallel.

21. The suspension apparatus of claim 16, wherein a cross section of at least one of said support members is C shaped.

22. The suspension apparatus of claim 16, wherein a cross section of at least one of said support members is I shaped.

23. The suspension apparatus of claim 16, wherein suspension apparatus becomes stiffer as a load upon said suspension apparatus increases.

* * * * *